US007581713B1

(12) United States Patent
Voss

(10) Patent No.: US 7,581,713 B1
(45) Date of Patent: Sep. 1, 2009

(54) JACK AND SAFETY STAND

(76) Inventor: Francis D. Voss, 105 W. Front St., Emerson, NE (US) 68733

( * ) Notice: Subject to any disclaimer, the term of this patent is extended or adjusted under 35 U.S.C. 154(b) by 0 days.

(21) Appl. No.: 11/986,448

(22) Filed: Nov. 21, 2007

Related U.S. Application Data

(60) Provisional application No. 60/860,383, filed on Nov. 21, 2006.

(51) Int. Cl.
*B66F 7/26* (2006.01)

(52) U.S. Cl. ..... 254/2 R; 254/8 B; 254/2 B; 254/7 B

(58) Field of Classification Search ..... 254/2 B, 254/8 B, 133 R, 93 H, 2 R; 144/195.1, 193.1
See application file for complete search history.

(56) References Cited

U.S. PATENT DOCUMENTS 3,327,996 A * 6/1967 Morse ..... 254/2 R
3,370,725 A * 2/1968 Jones ..... 414/458
3,647,183 A * 3/1972 Rishovd ..... 254/2 B
5,113,960 A * 5/1992 Prinz ..... 180/65.5
5,121,900 A * 6/1992 McDonald ..... 254/2 R
5,992,824 A * 11/1999 Voss ..... 254/2 B
6,056,309 A 5/2000 Brown
6,164,625 A 12/2000 Shockley et al.
6,406,007 B1 6/2002 Wilson
6,499,552 B2 12/2002 Bell
6,505,815 B1 * 1/2003 Dellamore ..... 254/2 B
6,505,816 B1 * 1/2003 Hung ..... 254/8 B
6,607,206 B2 8/2003 Petit
6,749,178 B1 * 6/2004 Loughner ..... 254/1
2005/0253121 A1 11/2005 Miner
2007/0059138 A1 3/2007 Cozza
2007/0194546 A1 8/2007 Cozza

* cited by examiner

*Primary Examiner*—Lee D Wilson
(74) *Attorney, Agent, or Firm*—Hamilton IP Law, PC.; Jay R. Hamilton; Charles A. Damschen

(57) ABSTRACT

The various embodiments disclosed and pictured herein illustrate a safety stand and jack for safety and easily positioning the load engaging portion of the jack directly against the frame of a heavy truck. Certain embodiments of the safety stand and jack employ an elongated support saddle that fits between the truck frame and suspension spring and distribute the load over a larger area at the bottom of the safety stand or jack.

20 Claims, 9 Drawing Sheets

JACK AND SAFETY STAND

CROSS REFERENCE TO RELATED APPLICATIONS

Applicant claims priority under 35 U.S.C. § 119(e) of provisional U.S. Patent Application Ser. No. 60,860,383 filed on Nov. 21, 2006 which is incorporated by reference herein.

FIELD OF INVENTION

Field of jacks and safety stands, particularly for trucks and other heavy equipment.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

SUMMARY OF THE INVENTION

The primary need for this invention is after lifting the front end of a new style truck, the front springs extend from the bumper all the way back to the fuel or air tanks and are directly under the frame making it virtually impossible to place regular safety stands in a position that is capable of safely securing the load.

The present art as disclosed and claimed herein utilizes an extra long support saddle and forward extended base with spring loaded wheels, allowing the unit to be rolled in from the side of the truck and the saddle to be placed securely under the truck frame without interference from the springs or steering mechanisms.

As disclosed in detail further herein the unit's extension arm has multiple holes for safety pin insertion for lift height adjustments. These height adjustment holes can be drilled either inline with lifting saddle (as shown) or crosswise.

As an optional feature a hydraulic pump and cylinder can be added, transforming the unit into a lifting jack/safety stand combination. The cylinder is fastened to the unit's base in front of the lifting column, and the cylinder rod is attached vertically to the brace under the support saddle of the extension. This positioning of the ram greatly reduces binding from the "off center" load factor when actually lifting the vehicle with the hydraulic system.

DETAILED DESCRIPTION - LISTING OF ELEMENTS

Figure 1:
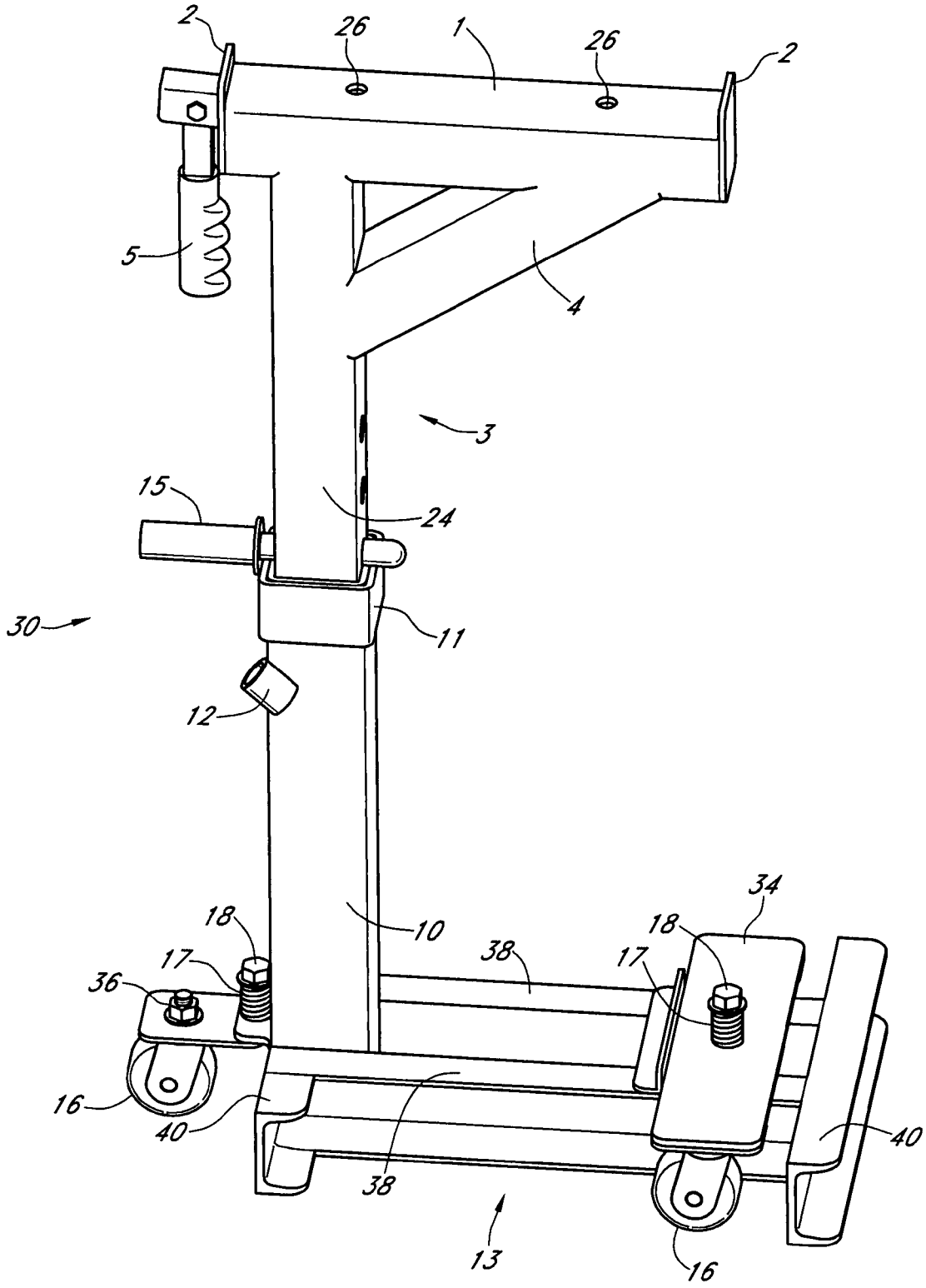
FIG. 1 is a perspective view of the safety stand.

| ELEMENT DESCRIPTION | ELEMENT # |
|---|---|
| Support Saddle | 1 |
| Stop Lug | 2 |
| Stem | 3 |
| Stem (short) | 3a |
| Stem (long) | 3b |
| Saddle Brace | 4 |
| Handle | 5 |
| Jack | 6 |
| Cylinder Rod | 7 |
| Cylinder Rod Holder | 8 |
| Handle Pin | 9 |
| Stem Base | 10 |
| Pin Reinforcement | 11 |
| Pin Holder | 12 |
| Platform Carriage | 13 |
| Saddle Extension | 14 |
| Pin | 15 |
| Wheels | 16 |
| Spring | 17 |
| Bolt | 18 |
| Pump Bracket | 19 |
| Cylinder | 20 |
| Cylinder First End | 20a |
| Cylinder Second End | 20b |
| Pump | 21 |
| Hose | 22 |
| Stem Mount | 23 |
| Engagement Member | 24 |
| Aperture | 25 |
| Alignment Aperture | 26 |
| Fixed Pin | 27 |
| Mounting Ear | 28 |
| Saddle Extension Mount | 29 |
| Safety Stand | 30 |
| Stop Lug Cover | 31 |
| Serated Surface | 32 |
| Cylinder Sleeve | 33 |
| Plate | 34 |
| Cylinder Sleeve ($1^{st}$ End) | 35 |
| Tab | 36 |
| Cylinder Sleeve ($2^{nd}$ End) | 37 |
| Side Member | 38 |
| Intentionally Blank | 39 |
| End Member | 40 |
| Intentionally Blank | 41 |
| Plate Tab | 42 |
| Intentionally Blank | 43 |
| Truck Frame | 44 |
| Intentionally Blank | 45 |
| Suspension Spring | 46 |

DETAILED DESCRIPTION

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. The material used to construct the jack and safety stand will depend on the particular application for the jack and safety stand. It is contemplated most applications will require iron or steel materials, but any suitable material such as polymers, wood, metal alloys, elemental metals, or combinations thereof may be used if advantages exist for a specific application.

Referring now to the drawings, wherein like reference numerals designate identical or corresponding parts throughout the several views, FIG. 1 provides a side view of a safety stand 30. A platform carriage 13 forms the bottom of the safety stand 30, and in the embodiment shown three caster wheels 16 are attached to the platform carriage 13 to allow for easily moving the safety stand 30 from one area to another. In the embodiment show in FIG. 1, two wheels 16 on the inner portion of the platform carriage 13 are directly mounted to a plate 34. A spring 17 with a bolt 18 therethrough provides a union between the plate 34 and the platform carriage 13 so that as a load is applied to the safety stand 30, the spring 17 compresses and the wheels 16 and plate 34 are elevated with respect to the platform carriage 13. In this manner, the platform carriage 13 rests upon the floor or supporting surface on which the wheels 16 previously rested, as is well known to those skilled in the art. A third wheel 16 is directly mounted to a tab 36 with a spring 17 and a bolt 18 in a similar matter, also well known to those skilled in the art.

In the embodiment shown in FIG. 1, the platform carriage 13 is primarily formed in a ladder pattern, wherein channel irons form two side members 38 parallel to each other. Channel irons also form two end members 40 parallel to each other and perpendicular to the side members 38. A plate tab 42 affixed to the side members 38 provides additional support for plate 34. Other orientations may be employed to construct the platform carriage 13, such as forming the side members 38 in a cross pattern, and specific orientations may be more appropriate for certain applications, depending on the load requirements for the safety stand 30. Accordingly, the specific orientation of the side members 38 and/or end members 40 in no way limit the scope of the present invention.

Affixed to the platform carriage 13 is a stem base 10. The stem base 10 is formed as a box-shaped, elongated hollow sleeve with one end affixed to the platform carriage 13 and the opposite end forming an opening. A pin holder 12 may be affixed to the stem base 10 to hold a pin 15 (described in detail below) when the pin 15 is not inserted into an aperture 25. In the embodiment shown in FIG. 1, a pin reinforcement 11 is included on the end of the stem base 10 that forms an opening to provide additional support to the stem base 10 when its position is locked with the use of a pin 15. The pin reinforcement 11 shown in FIG. 1 is simply a thick band of material affixed to the outer perimeter of the stem base 10. The material used to form the pin reinforcement 11 may be the same material used to form the stem base 10, or any other suitable material.

A stem 3 includes an elongated engagement member 24 that is fashioned to fit into and slideably engage the stem base 10. The engagement member 24 is the same cross-sectional shape as the stem base 10, but of a lesser perimeter to allow insertion of the engagement member 24 through the opening and into the stem base 10. The engagement member 24 may be hollow or solid, depending on the application. The engagement member 24 has at least one aperture 25 formed therein and passing through the entire width of the engagement member 24. The apertures 25 may be parallel to the side members 40, as shown in FIG. 1, or they may be parallel to the end members 40. When a plurality of apertures 25 are used, the apertures 25 may be spaced at any convenient distance from one another as long as the structural integrity of the engagement member 24 is not adversely affected beyond use in the application for which the safety stand 30 is designed. The aperture 25 is fashioned to accept a pin 15, so that when the engagement member 24 is inserted into the stem base 10 and a pin 15 is inserted into an aperture 25, the pin 15 will engage the stem base 10 upon a load being placed on the engagement member 24 so that the vertical position of the engagement member 24 with respect to the stem base 10 is locked. As described above, the stem base 10 may include a pin reinforcement 11 to provide additional structural support and rigidity to the stem base 10, particularly to the area of the stem base 10 near the opening, which area engages the pin 15.

Figure 2:
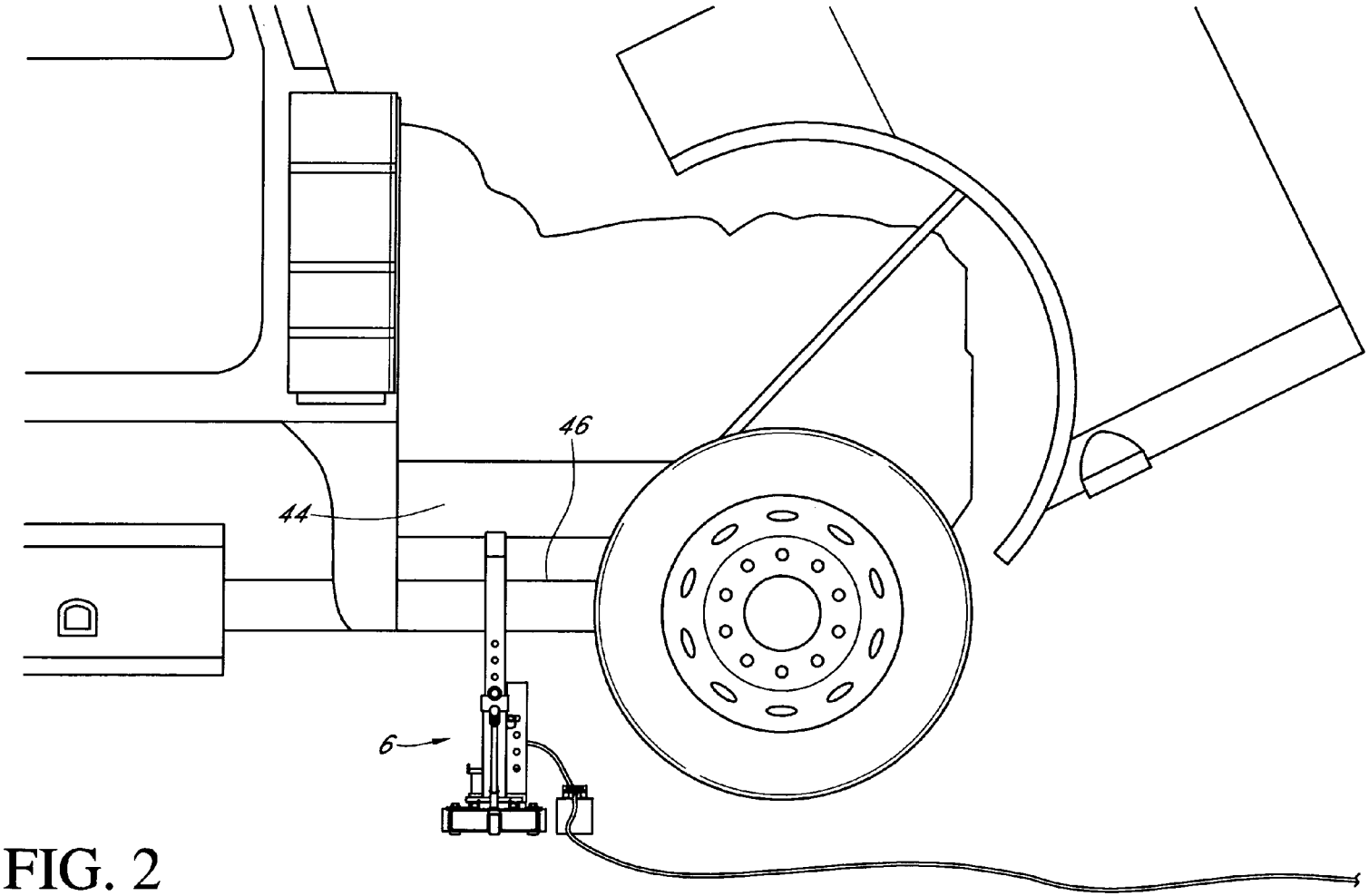
FIG. 2 is a perspective view of the safety stand engaged with the frame of a heavy truck.
Figure 3:
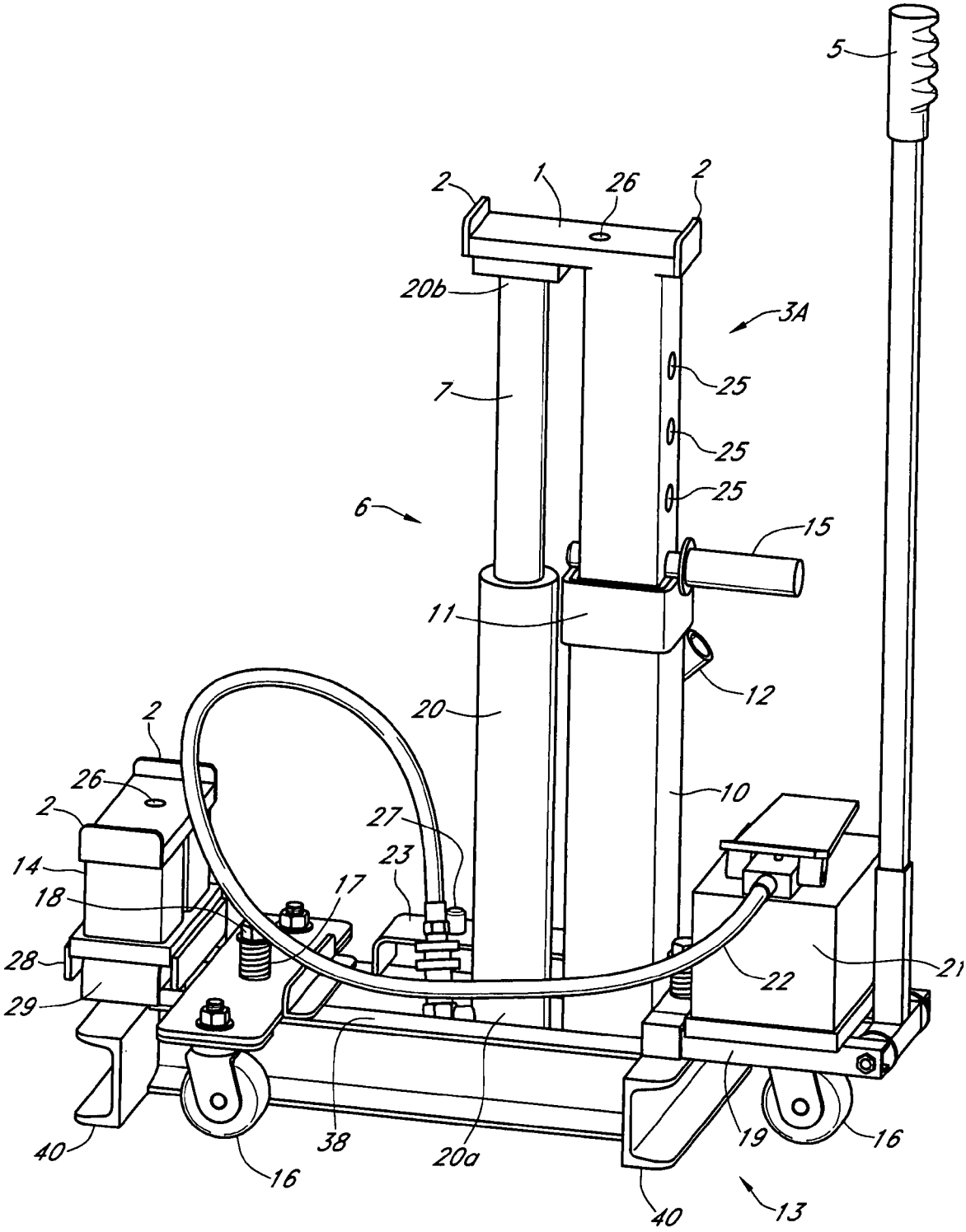
FIG. 3 is a perspective view of the jack with a stem not having a saddle brace.

The stem 3 also includes a support saddle 1 affixed to one end of said engagement member 24 opposite the platform carriage 13. The support saddle 1 provides the engagement surface for the load the safety stand 30 is positioned to support. In the embodiment shown in FIG. 1, the support saddle 1 is elongated so that it may easily be placed between the suspension spring 46 and truck frame 44 of a heavy truck as shown in FIG. 2. In the embodiment shown in FIG. 1, the support saddle 1 includes stop lugs 2 at each end so that when a load is engaged with the support saddle 1, the load is not able to shift past either stop lug 2. As shown, the support saddle 1 has alignment apertures 26 facing the load. These alignment apertures cooperatively engage and fit with pins positioned on either saddle extension Furthermore, in this embodiment a saddle brace 4 is affixed to the support saddle 1 and the engagement member 24 to provide structural integrity to the support saddle 1 and increase the load-bearing capability of the safety stand 30. A handle 5 may be hingedly connected to the support saddle 1 to facilitate moving the safety stand 30 when it is not under load. The handle 5 may be mounted in a hinged manner so that gravity will cause the handle 5 to retract to a more compact position when the handle 5 is not in use. Alternatively, an elongated handle 5, such as the handle 5 shown in FIG. 4, may be attached to the platform carriage 10.

As is readily apparent to those skilled in the art, the safety stand 30 is configured for easy and safe placement on a heavy truck. Because the stem base 10 is positioned at one end of the carriage base 13, which allows the support saddle 1 to extend towards the load supported by the safety stand 30 in the same direction as platform carriage 13, the safety stand 30 may be positioned so the support saddle 1 extends between the truck frame 44 and suspension spring 46 of a truck and the majority of the platform carriage 13 is extends under the truck directly below the support saddle 1. (See FIG. 2.) The length by which the support saddle 1 extends beyond the engagement member 24 may be different in different embodiments, and the length and angle of the saddle brace 4 may also be different for different embodiments or the saddle brace 4 may not be used in certain embodiments, as is readily apparent to those skilled in the art.

Figure 4:
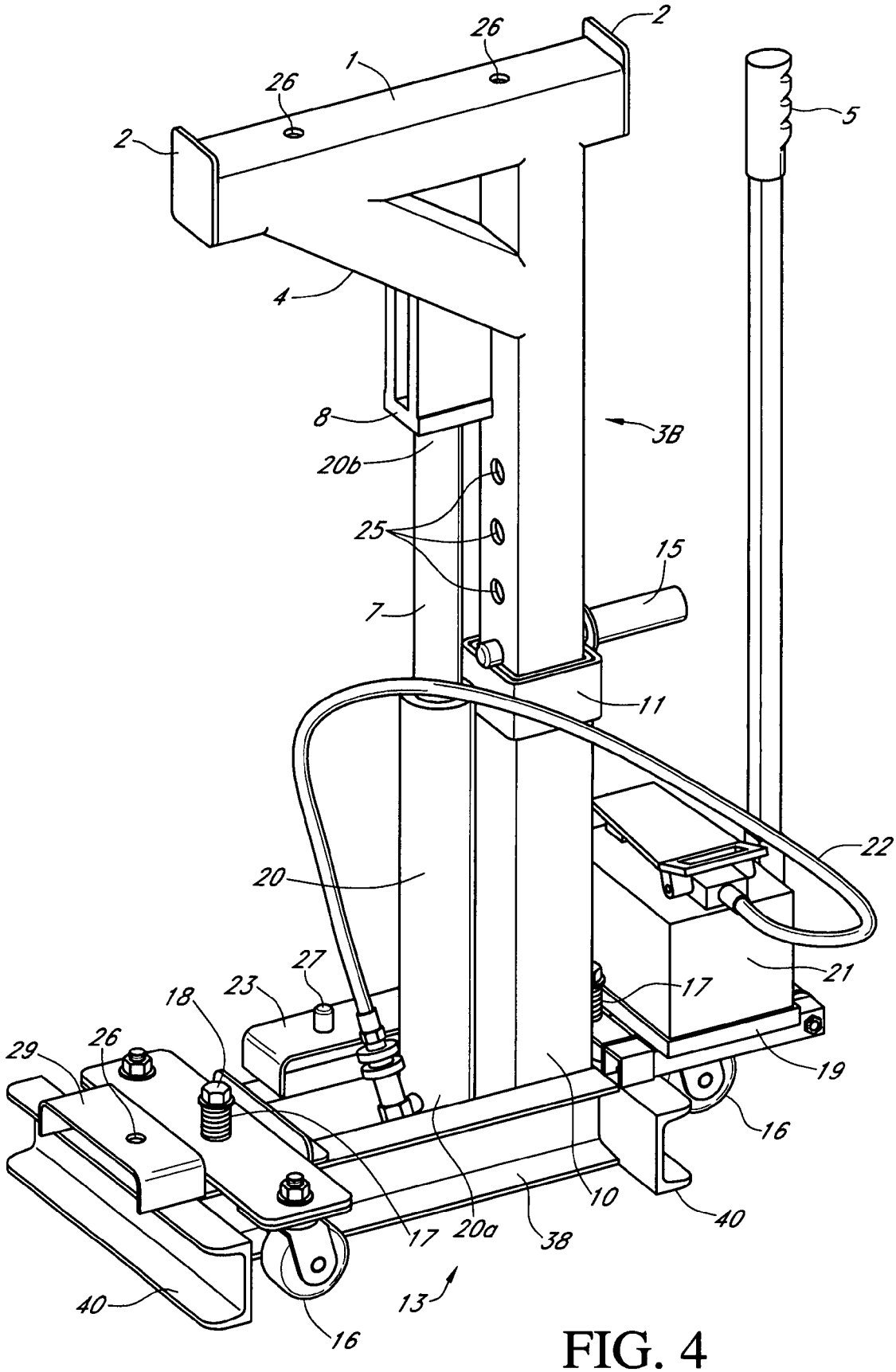
FIG. 4 is a perspective view of the jack with a stem having a saddle brace.
Figure 6:
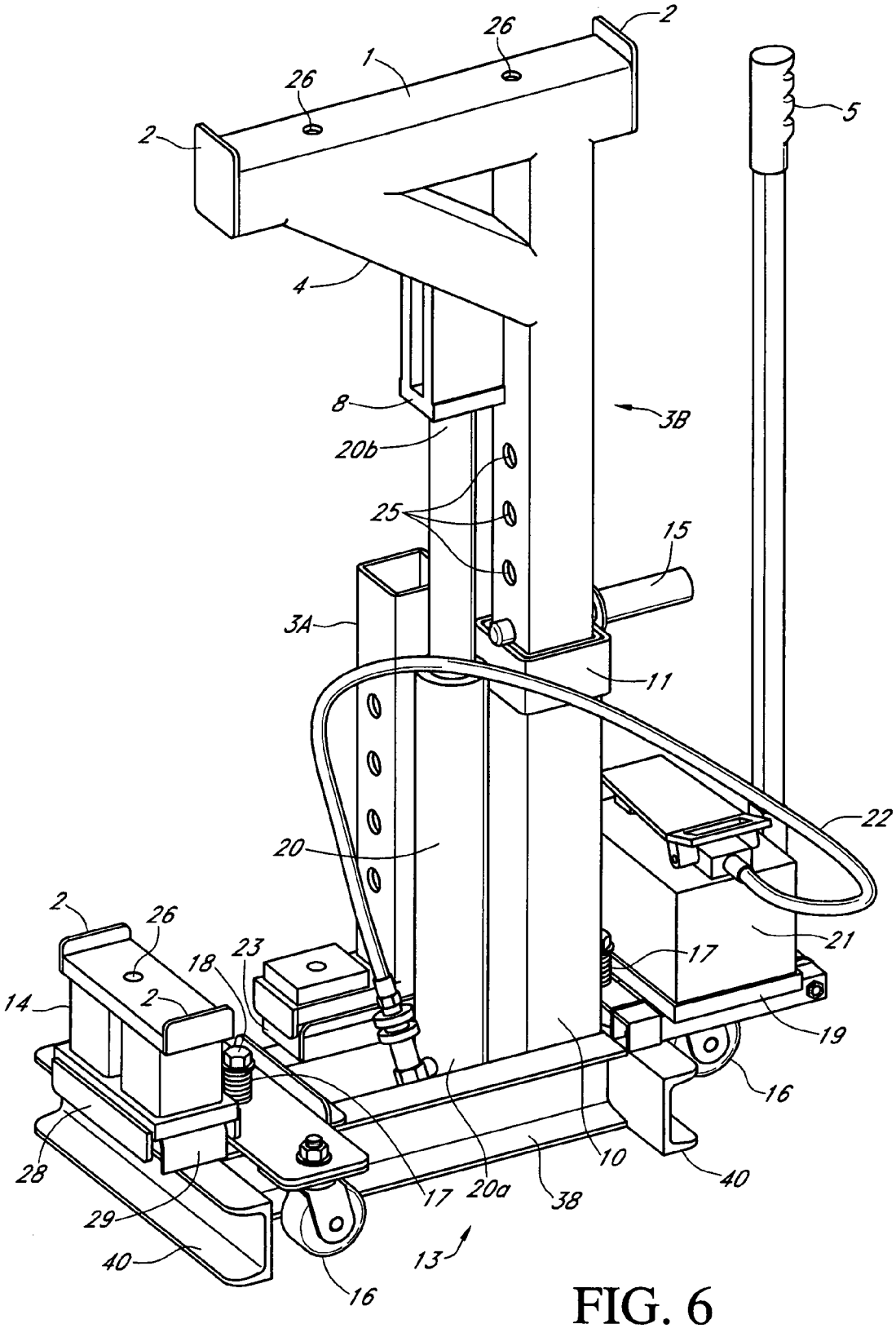
FIG. 6 is a perspective view of a jack with a platform carriage fashioned to store another stem and support saddle.

FIG. 4 provides a side view of a jack 6 that incorporates the improvements described above as applied to a safety stand 30. The platform carriage 13 for the jack 6 is essentially the same as the platform carriage 13 for the safety stand 30. However, the platform carriage of the jack 6 may include a pump bracket 19 into which a pump 21 may be secured. Additionally, an elongated handle 5 may be hingedly attached to the platform carriage 13 as shown in FIG. 4, or a handle may be attached to the saddle support 1 as shown for the safety stand 30 in FIG. 1. The platform carriage 13 may also be fashioned so that different stem 3 and support saddle 1 embodiments may be conveniently stored on the platform carriage 13, as shown in FIG. 6.

The stem 3 used for the jack 6 is essentially the same as the stem used for the safety stand 30 so that the vertical position of the stem 3 with respect to the stem base 10 may be locked as with the safety stand 30. However, the stem 3 used with the jack 6 must also include a cylinder rod holder 8, which is described in detail below.

The jack 6 includes a cylinder 20 with a cylinder first end 20*a* connected to the platform carriage 13 and a cylinder second end 20*b* connected to a cylinder rod holder 8. The cylinder first end 20*a* may be connected to the platform carriage 13 in any manner known to those skilled in the art, such as through nuts and bolts, or any other suitable means. Similarly, the cylinder second end 20*b* may be connected to the cylinder rod holder by any manner known to those skilled in the art. In the embodiment shown in FIG. 4, the cylinder rod holder 8 is affixed to the saddle brace 4, but the cylinder rod holder 8 may be affixed to the underside of the support saddle 1 in an alternative embodiment of the stem 3 shown in FIG. 5 and described in detail below. The cylinder 20 may be one actuated with any type of pressurized fluid suitable for the particular application, including hydraulic fluid, air, or any other fluid known to those skilled in the art. The cylinder 20 is fluidly connected to the pump 21 via a hose 22. As is well known to those skilled in the art, actuation of the pump manipulates the fluid pressure within the cylinder 20, thereby manipulating the extension of the cylinder 20.

Figure 5A:
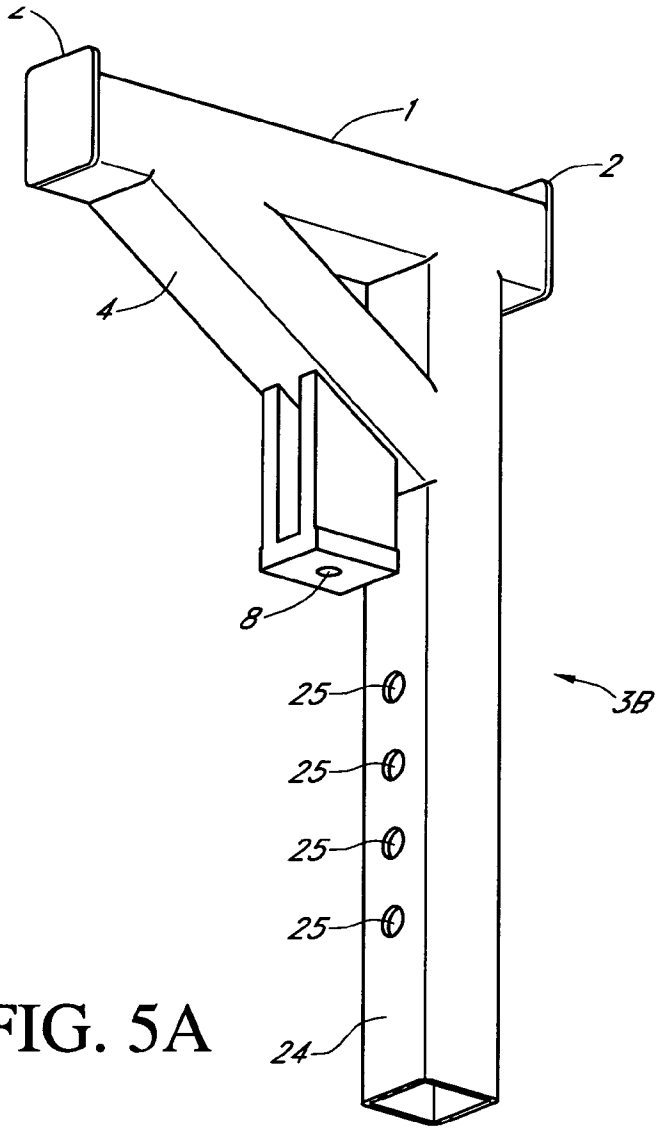
FIG. 5A is a perspective view of a stem with a saddle brace.
Figure 5:
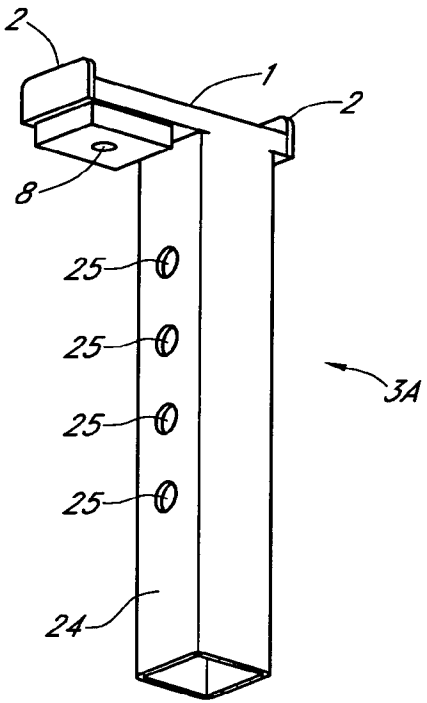
FIG. 5 is a perspective view of a stem without a saddle brace.

FIG. 5 shows a stem 3 without a saddle brace 4. In this embodiment, the saddle support 1 does not extend from the engagement member 24 as far as it does in embodiments employing a saddle brace 4. The stem 3 shown in FIG. 6 may be used with the safety stand 30 or the jack 6. If used with the jack 6, a cylinder rod holder 8 is fashioned on the underside of the support saddle 1. As is readily apparent to those skilled in the art, the stem 3 (labeled 3*a*) as shown in FIG. 5, when used with the jack 6, can support a larger load than the stem 3 (labeled 3*b*) shown in FIG. 4, all else being equal. Additionally, as one of ordinary skill in the art will appreciate from the present disclosure, positioning the cylinder 20 outside of the stem 3 versus placement of a cylinder within a stem, as is known in the prior art, allows for improved access to load bearing surfaces, which thereby increases available load bearing area. As shown and illustrated, when used as a jack 6, the safety stand 30 uses not only the bearing surfaces of both the telescoping base (3, 11, 10) and the cylinder rod 7, but also the bearing surfaces of the piston and guide of the cylinder. The design and orientation then of the present art allows increased access to the bearing surface of the cylinder 20 and cylinder rod 7 which is not present in the prior art. This increase in available bearing surface increases the ease in lifting a load thereby demonstrating to applicant the reduction in shear forces allowed by the present art arrangement.

Figure 7:
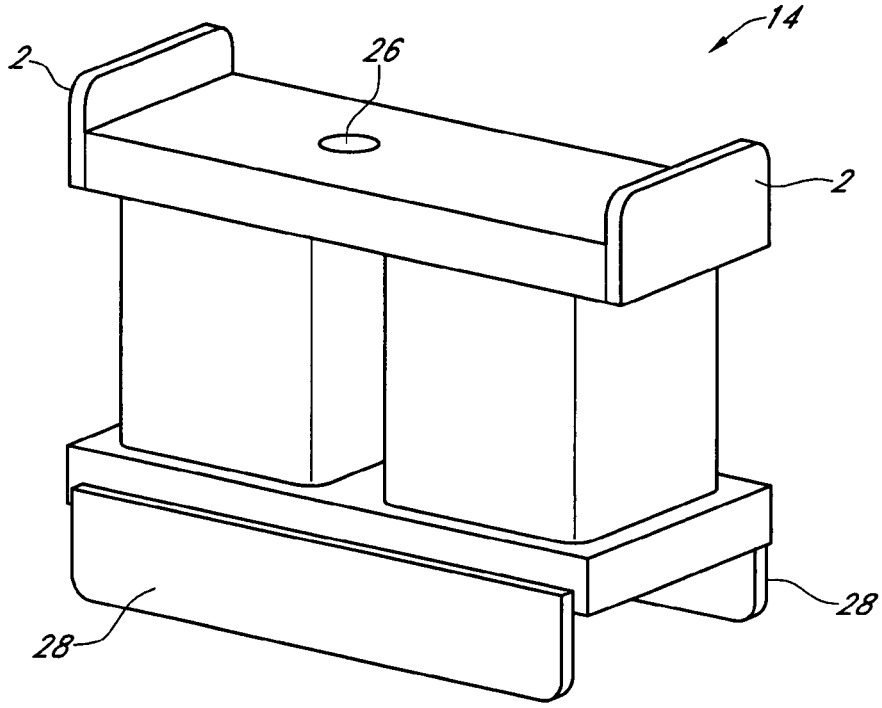
FIG. 7 is a perspective view of the saddle extension shown in FIGS. 3 and 6.
Figure 8:
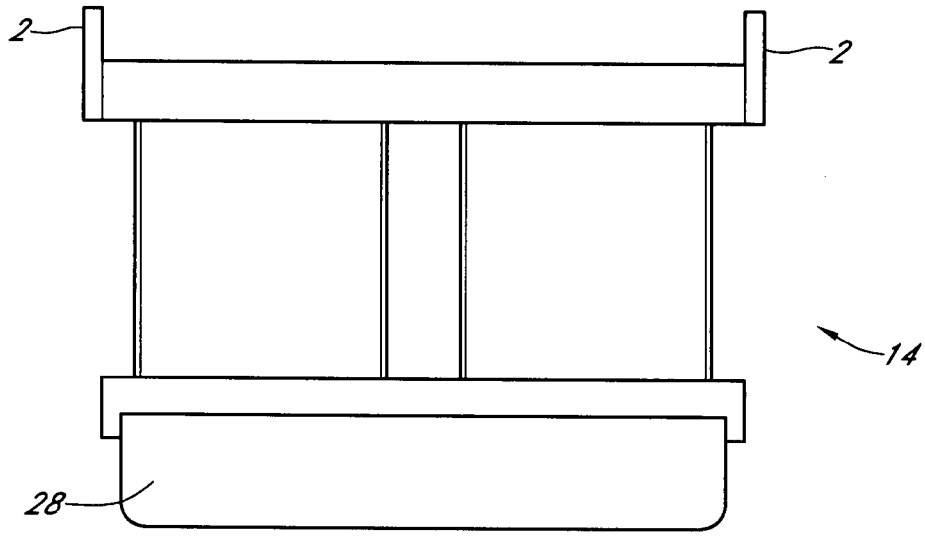
FIG. 8 is a side view of the saddle extension of FIG. 7.

FIG. 7 is a perspective view of a saddle extension 14 which may be slideably engaged with a saddle extension mount 29 so when the saddle extension 14 is not needed, it may be positioned within reach of the user but out of the way of the stem 3. FIG. 8 is an end view of the saddle extension 14. As shown, mounting ears 28 are orientated to fit onto and over saddle extension mount 29 for cooperative engagement for fixation of the relative position. Additionally, saddle extension mount 29, as shown in FIGS. 4 and 6, may have an alignment aperture 26 therein for cooperative engagement with a fixed pin 27 mounted to the saddle extension 14.

Figure 9:
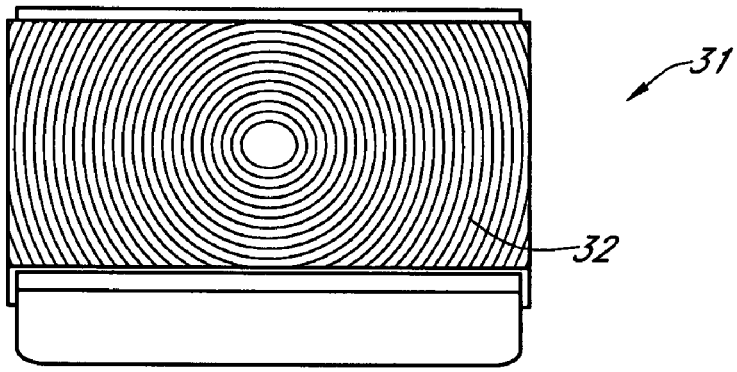
FIG. 9 is a perspective view of a stop lug cover having a serated top surface.
Figure 10:
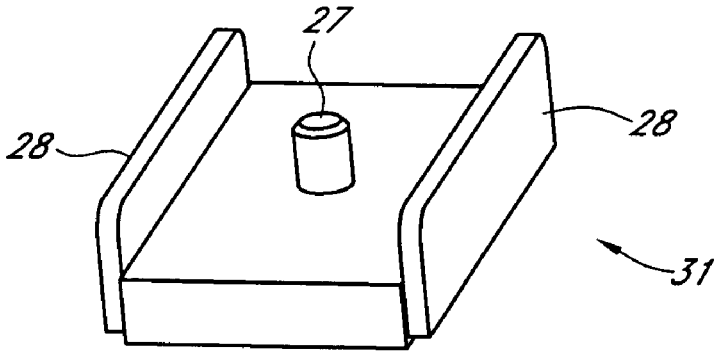
FIG. 10 is an end view of the stop lug cover of FIG. 9.

FIG. 9 is a top perspective view of a stop lug cover 31 having a serated top surface 32. The stop lug cover 31 engages with the top surface of the support saddle 1 to provide a uniform loading surface and to protect the stop lugs 2. This feature is used in situations where the width of the engaged surface of the load is greater than the distance between the stop lugs 2 so engagement with the surface between the stop lugs 2 is inhibited. In this situation, the stop lug cover 2 provides a uniform load bearing surface for engagement with the load. The serrated surface 32 allows for adequate gripping with the load surface. FIG. 10 is a perspective view of the opposite side of the stop lug cover 2 as shown in FIG. 9 to better illustrate the mounting ears 28 and fixed pin 27 for cooperative engagement with support saddle 1.

Figure 11:
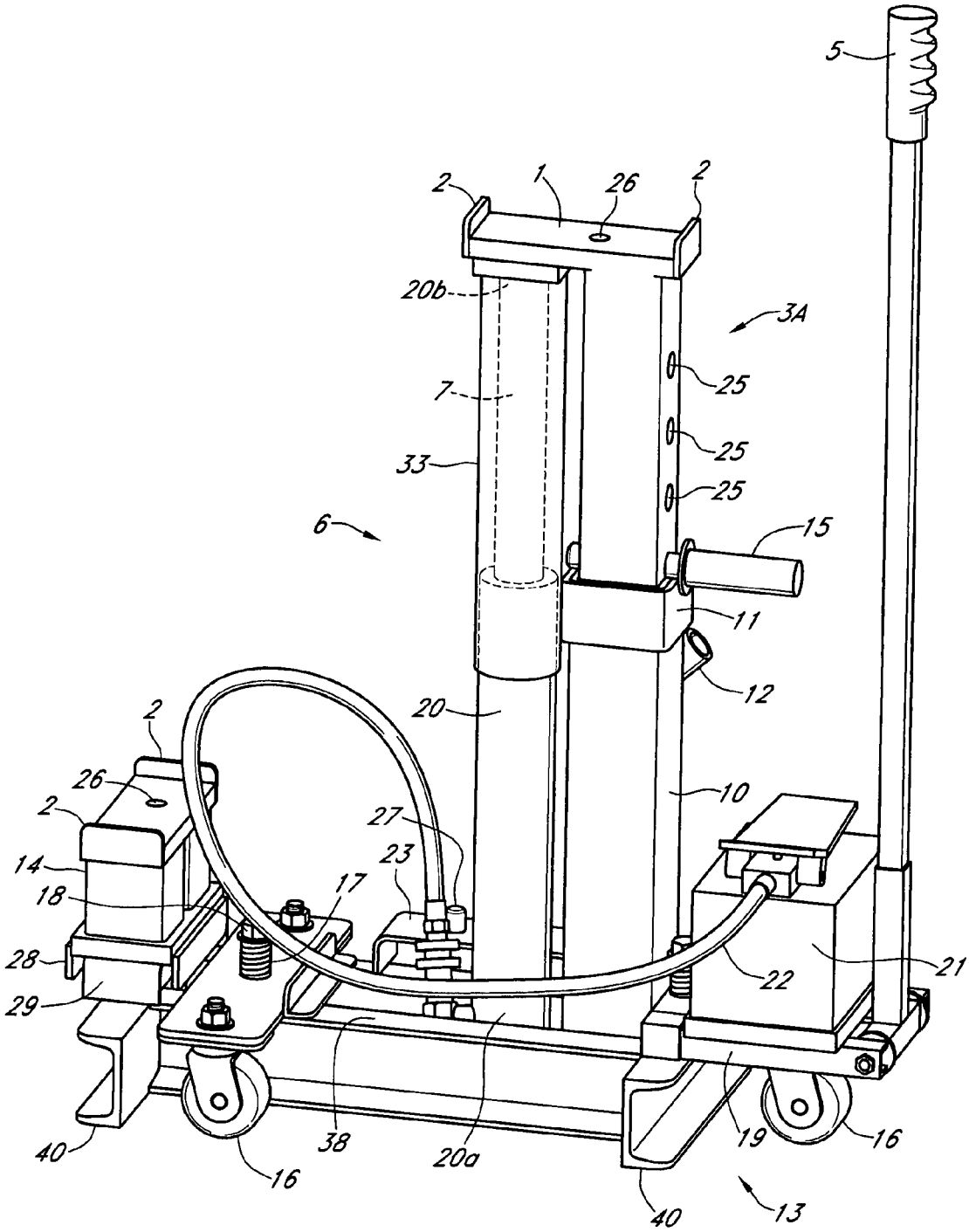
FIG. 11 is another embodiment of the jack of FIGS. 3-6 wherein a sleeve is placed over the cylinder tube.

FIG. 11 is another embodiment of the jack 6 of FIGS. 3-6 wherein a cylinder sleeve 33 is placed over the cylinder rod 7. As shown the in FIG. 11, the cylinder sleeve 33 is attached at a first end to the cylinder 20 at cylinder second end 20*b* to cover and protect cylinder rod 7. The second end of the cylinder sleeve 37 is open to allow for slideable insertion of cylinder 20 during retraction of cylinder rod 7 into cylinder 20. Cylinder sleeve 33 serves to protect cylinder rod 7 during extension and retraction from cylinder 20. As one of ordinary skill will appreciate, the length of cylinder sleeve 33 is limited by the length of cylinder rod 7 and is sized accordingly.

It should be noted that the present invention is not limited to the specific embodiments pictured and described herein, but is intended to apply to all similar apparatuses for supporting a load and allowing hydraulic assisted lifting of a load such as semi-tractor. Modifications and alterations from the described embodiments will occur to those skilled in the art without departure from the spirit and scope of the present invention.

The invention claimed is:

1. A safety stand for supporting heavy vehicles suspended above a surface comprising:

a. a platform carriage 13;

b. a hollow vertically orientated stem base 10, wherein said stem base 10 has a first and second end, wherein said second end of said stem base 10 is at a higher elevation than said first end of said stem base 10, wherein said first end of said stem base 10 is attached to said carriage platform 13, and wherein said second end of said stem base forms an opening;

c. a stem 3, said stem 3 comprising:

i. an engagement member 24, wherein said engagement member 24 fits into and is slideable with respect to said stem base 10 through said second end of said stem base, and wherein said engagement member 24 is formed with a plurality of apertures 25 therethrough;

ii. a support saddle 1 affixed to one end of said engagement member opposite said platform carriage 13;

d. a pin 15, wherein said pin 15 is insertible in one of aperture of said plurality of apertures 25 in said engagement member 24, and wherein said pin 15 is engageable with said second end of stem base 10 when inserted in one of said apertures; and, e. a plurality of wheels, wherein said plurality of wheels are mounted to at least one plate, and wherein said plate is mounted to said platform carriage with a spring and a bolt so that said platform carriage engages said surface when a load is placed on said safety stand.

2. The safety stand according to claim 1 wherein said platform carriage is further defined as two parallel side members affixed to two parallel end members.

3. The safety stand according to claim 1 further comprising a pin holder affixed to said stem base.

4. The safety stand according to claim 1 further comprising a handle hingedly connected to said support saddle.

5. The safety stand according to claim 1 further comprising an elongated handle hingedly connected to said platform carriage.

6. The safety stand according to claim 1 wherein said safety stand has a saddle extension for cooperative engagement with said saddle support.

7. The safety stand according to claim 1 wherein a stop lug cover may be cooperatively mounted to and upon said saddle support to create a continuous horizontal surface for contact with a load.

8. A jack for raising and supporting heavy vehicles suspended above a surface comprising:

a. a platform carriage 13, wherein a plurality of wheels 16 are attached to said platform carriage 13;

b. a hollow vertically orientated stem base 10, wherein said stem base has a first and second end, wherein said second end of said stem base 10 is at a higher elevation than said first end of said stem base 10, wherein said first end of said stem base 10 is attached to said carriage platform 13, and wherein said second end of said stem base forms an opening;

c. a stem 3, said stem 3 comprising:

i. an engagement member 24, wherein said engagement member 24 fits into and is slideable with respect to said stem base 10 through said second end of said stem base, and wherein said engagement member 24 is formed with a plurality of apertures 25 therethrough;

ii. a support saddle 1 affixed to one end of said engagement member opposite said platform carriage 13;

iii. a cylinder rod holder 8 affixed to said support saddle 1, wherein said cylinder rod holder 8 is fashioned to engage said cylinder second end 20*b;* d. a cylinder 20 having a cylinder first end 20*a* and a cylinder second end 20*b*, wherein said cylinder first end 20*a* is attached to said platform carriage 13, wherein said cylinder second end 20*b* is attached to said cylinder rod holder 8 of said stem 3, wherein said cylinder 20 extends from said platform carriage 13 in an axial direction substantially parallel to the longitudinal axes of both said engagement member 24 of said stem 3 and said stem base 10, and wherein the direction of actuation of said cylinder 20 is substantially perpendicular to said support saddle 1; and e. a pin 15, wherein said pin 15 is insertible in one aperture of said plurality of apertures 25 in said engagement member 24, and wherein said pin 15 is engageable with said second end of stem base 10 when inserted in one of said apertures.

9. The jack according to claim 8 wherein said platform carriage is further defined as two parallel side members affixed to two parallel end members.

10. The jack according to claim 8 further comprising a pin holder affixed to said stem base.

11. The jack according to claim 8 further comprising a handle hingedly connected to said support saddle.

12. The jack according to claim 8 further comprising an elongated handle hingedly connected to said platform carriage.

13. The jack according to claim 8 wherein said jack is further defined as having a plurality of wheels, wherein said plurality of wheels are mounted to at least one plate, and wherein said plate is mounted to said platform carriage with a spring and a bolt so that said platform carriage engages said surface when a load is placed on said jack.

14. The jack according to claim 9 wherein said platform carriage has a stem mount 23 orientated for cooperative engagement with a non-load bearing support saddle.

15. The jack according to claim 9 wherein said platform carriage has a stem mount 23 orientated for cooperative engagement with a non-load bearing support saddle.

16. The jack according to claim 9 wherein a saddle extension may be cooperatively engaged with said support saddle to selectively extend the height of the support saddle without further extension of said cylinder rod.

17. The jack according to claim 16 wherein a saddle extension mount may be cooperatively engaged with a no-load bearing saddle extension.

18. The jack according to claim 16 wherein a cylinder sleeve 33 may be attached at said second end of said cylinder to protect said cylinder rod during extension and retraction.

19. The safety stand according to claim 1 wherein said plurality of wheels is further defined as including three wheels.

20. The safety stand according to claim 19 wherein said at least one plate is further defined as a first plate and a second plate, wherein said first plate has two of said wheels attached thereto, and wherein said second plate has one of said wheels attached thereto.

* * * * *